US007967625B2

(12) United States Patent
Fujiwara et al.

(10) Patent No.: US 7,967,625 B2
(45) Date of Patent: Jun. 28, 2011

(54) PACKING PROTECTION CAP AND CONNECTOR

(75) Inventors: Yoshihito Fujiwara, Tokyo (JP); Katsumi Shiga, Chiba (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 72 days.

(21) Appl. No.: 12/432,924

(22) Filed: Apr. 30, 2009

(65) Prior Publication Data

US 2009/0275227 A1 Nov. 5, 2009

(30) Foreign Application Priority Data

Apr. 30, 2008 (JP) ..... 2008-118848

(51) Int. Cl.
*H01R 13/52* (2006.01)

(52) U.S. Cl. ..... 439/271

(58) Field of Classification Search ..... 439/271, 439/352, 892, 135, 140, 141; 350/96.2
See application file for complete search history.

(56) References Cited

U.S. PATENT DOCUMENTS 6,514,098 B2 * 2/2003 Marpoe et al. ..... 439/352
2002/0111071 A1 * 8/2002 Pade ..... 439/620

FOREIGN PATENT DOCUMENTS

JP 08-064298 3/1996
JP 2001-267004 9/2001

* cited by examiner

*Primary Examiner* — Alexander Gilman
(74) *Attorney, Agent, or Firm* — Barley Snyder LLC

(57) ABSTRACT

An electrical connector includes a connector body and a seal protection cap. The connector body includes a cap housing, a body, and a fitting section provided with a seal. The seal protection cap includes a front face plate and a protection section. The front face plate is provided with an opening in order to allow a continuity check from a front face of the fitting section. The protection section extends cylindrically from a peripheral edge of the front face plate along a side face of the fitting section so as to cover the seal. The seal protection cap is applied to the fitting section of the connector body so as to cover the seal.

4 Claims, 23 Drawing Sheets

PACKING PROTECTION CAP AND CONNECTOR

CROSS-REFERENCE TO RELATED APPLICATIONS

This application claims the benefit of the filing date under 35 U.S.C. §119(a)-(d) of Japanese Patent Application number 2008-118848 filed Apr. 30, 2008.

FIELD OF THE INVENTION

The present invention relates to a seal protection cap for protecting a fitting portion of an electrical connector to be fitted to a mating connector and for protecting a seal provided on the fitting portion, and to an electrical connector including the seal protection cap.

BACKGROUND

An electrical connector having a fitting portion to be fitted to a mating connector and a seal provided on the fitting portion is readily known. In the case where such a connector is used for an airbag system for an automobile, for example, the fitting portion and the seal of this connector are often protected with a seal protection cap in order to ensure safety and reliability until the connector is mated with the mating connector.

For example, Japanese Patent Application Publication No. 08-64298 proposes a waterproof electrical connector including a seal that is provided inside a fitting concave section to be fitted to a fitting section of a mating connector while the seal is partially exposed on an outer periphery of the fitting concave section. In this connector, the exposed portion of the seal is covered with a protection cover that is put on the outer periphery of the fitting concave section.

Meanwhile, Japanese Patent Application Publication No. 2001-267004 proposes a cap-shaped dust cover to be fitted onto an outer periphery of a connector so as to cover a front face of a fitting portion of the connector. In this application, a seal protection section is formed in an extending manner on an opening end of a peripheral wall of the dust cover so as to cover a seal exposed on a rear-end outer periphery of the connector.

However, when putting the protection cover on the outer periphery of the fitting concave section as proposed in Japanese Patent Application Publication No. 08-64298, the portion of the seal that is exposed on the outer periphery of the fitting concave section is protected by the protection cover, whereas a front end side of the seal provided inside the fitting concave section is not protected by the protection cover. Therefore, an insufficient protection of the seal results.

Meanwhile, again, according to Japanese Patent Application Publication No. 2001-267004, the seal exposed on the rear-end outer periphery of the connector is covered with the seal protection section that extends on the opening end of the peripheral wall of the cap-shaped dust cover to be fitted to the outer periphery of the connector. In this application, the front face of the connector, in a fitting direction in which the connector is fitted to the mating connector, is covered with the dust cover. Thus, it is impossible to carry out a visual inspection of the connector or a continuity check of a contact after putting the dust cover on the connector. Therefore, this connector has a problem of poor workability in its manufacturing process.

SUMMARY

In view of the foregoing problems, the present invention provides a seal protection cap to protect a fitting portion as well as a seal, while improving workability. The present invention also provides a connector having the seal protection cap.

The seal protection cap for a connector body, according to the present invention, includes a connector body having a fitting section and a seal. The fitting section, which is fitted to a fitting concave section of a mating connector, has a contact hole formed in a front face thereof in a fitting direction, in which the fitting section is fitted to the fitting concave section. The contact hole extends far enough to reach a contact disposed inside the fitting section. The seal surrounds a side face of the fitting section. The seal protection cap includes a front face plate and a protection section. The front face plate, which spreads to face the front face, includes an opening to allow inspection from the front face. The protection section extends cylindrically from a peripheral edge of the front face plate along the side face of the fitting section so as to cover the seal.

Since the seal protection cap of the present invention includes the front face plate provided with the opening, it is possible to carry out a continuity check while touching contacts disposed inside the connector body with the seal protection cap kept on the connector body. Therefore, workability can be improved.

According to the present invention, it is possible to provide a seal protection cap capable of protecting a fitting portion as well as a seal and improving workability at the same time, and to provide a connector including the seal protection cap.

DETAILED DESCRIPTION OF THE EMBODIMENT(S)

Now, an embodiment of the present invention will be described with reference to the accompanying drawings.

A connector 1 shown in FIG. 1 to FIG. 3B is a connector to be connected, via wires 20, to a mating connector (not shown) that is provided on an ignition device of a vehicle airbag system (also not shown). The connector 1 includes a connector body 1_1 and a seal protection cap 1_2.

Figure 3A:
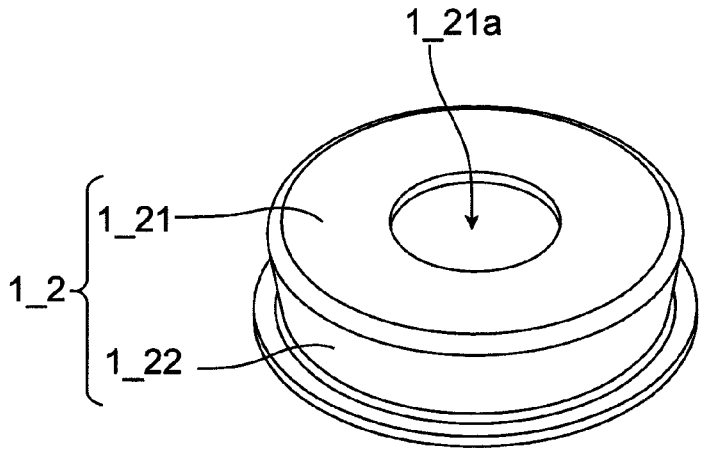
FIGS. 3A and 3B are views of the connector shown in FIG. 2, which show a state in which a seal protection cap is detached from a connector body.
Figure 3B:
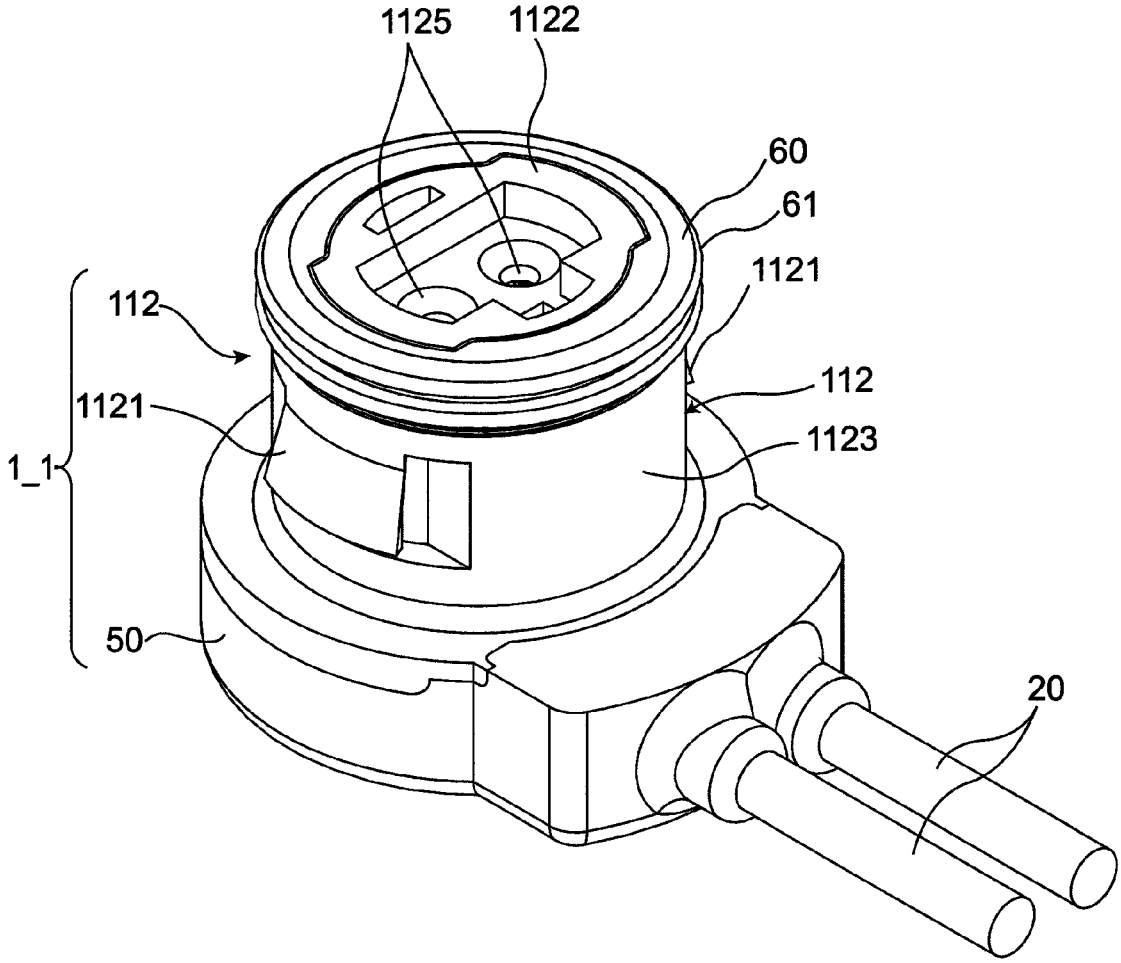

The connector body 1_1 includes a body 50, a fitting section 112, and a seal 60 as shown in FIG. 3B.

The body 50 corresponds to an example made of an insulative material such as a resin-made head section. This body 50 is arranged at a rear portion of the fitting section 112 in a fitting direction in which the fitting section 112 is fitted to the mating connector. The body 50 seals portions around the wires 20 extending from the rear portion. The body 50 is integrally molded with the fitting section 112 as well as insulation on the wires 20, by use of a mold to be described later. A material such as polyamide-based hot-melt or polyester-based hot-melt may be used for the body 50 but it should be understood by those skilled in the art that other insulative materials would be suitable for the body 50. Therefore, the materials of the body 50 are not limited only to those mentioned above. It is possible to employ any other materials as long as such materials allow the body 50 to be formed by means of a mold, at a low pressure in a short period of time, thereby obtaining the body 50 integral with the fitting section 112 and the insulation coatings of the wires 20. Moreover, this material is expected to have affinity for the materials of the fitting section 112 and the insulation of the wires 20 while preventing adhesion to the mold.

The fitting section 112 is fitted to a fitting concave section (not shown) of the mating connector. This fitting section 112 includes an outer peripheral surface 1123 provided with a lock 1121. The lock 1121 plays a role in preventing detachment of the mating connector when the fitting section 112 is inserted to a predetermined position of the fitting concave section of the mating connector. Moreover, as shown in FIG. 3B, this fitting section 112 includes contact holes 1125 formed on a front face 1122 in the fitting direction, which are configured to reach contacts arranged inside the fitting section 112, as will be described later.

As shown in FIG. 3B, the seal 60 is arranged so as to surround a side face of the fitting section 112. This seal 60 is formed, for example, by insert-molding of silicone rubber onto an outer peripheral surface 1123 of the fitting section 112 formed in advance. The silicone rubber adheres to the fitting section 112 in the course of the insert-molding process and thereby forms the seal 60 that is integrated with the fitting section 112. Here, the seal 60 may also be formed simultaneously and integrally with the fitting section 112 by means of a two shot molding process wherein different color material may optionally be used for each component. The seal 60 has an annular shape so as to surround part of the outer peripheral surface 1123, and a lip 61 is formed on the outermost periphery of the seal 60. The lip 61 protrudes from the outer peripheral surface 1123 so that an outside diameter of the seal 60 is larger than an inside diameter of the fitting concave section of the mating connector. That is, the seal 60 is formed so as to be in intimate and elastic contact with an inner wall of the fitting concave section of the mating connector when the fitting section 112 is inserted to the fitting concave section.

Figure 2:
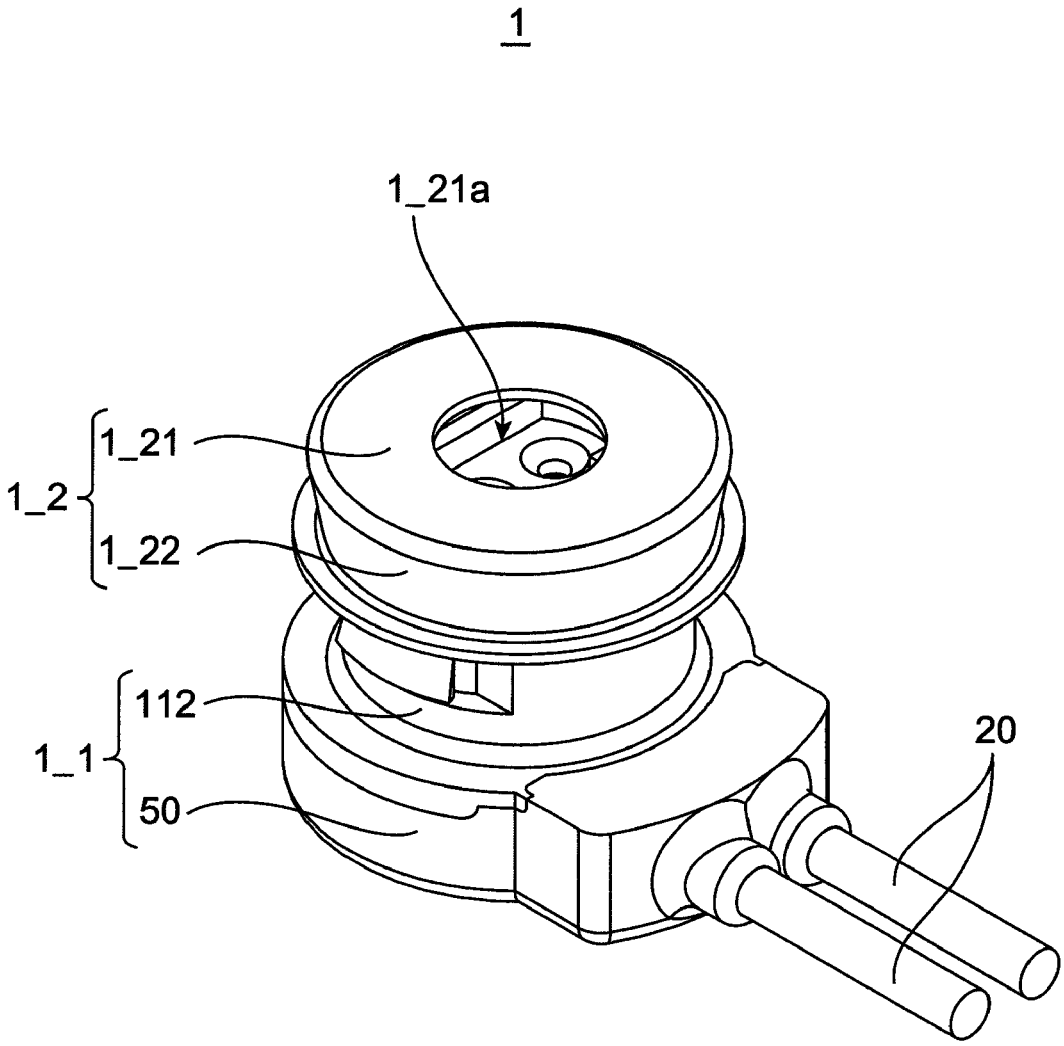
FIG. 2 is a perspective view of the connector shown in FIG. 1, which is viewed from the side used for fitting.

Meanwhile, as shown in FIG. 2 and FIG. 3A, the seal protection cap 1_2 includes a front face plate 1_21 and a protection section 1_22. The front face plate 1_21 is spread to face the front face 1122 of the fitting section 112 and includes an opening 1_21*a* in order to allow an inspection from the front face 1122. The protection section 1_22 is a member that extends from a peripheral edge of the front face plate 1_21 cylindrically along the side face of the fitting section 112, so as to cover the seal 60.

Moreover, the seal protection cap 1_2, in the embodiment shown, is made of highly-transparent polypropylene so as to allow the connector body 1_1 to be visible through the seal protection cap 1_2. However, the material of the seal protection cap 1_2 is not limited only to polypropylene. The seal protection cap of the present invention only needs to be made of a transparent material that allows the connector body to be visible through this seal protection cap.

The configuration of the connector 1 will be described further in detail with reference to FIG. 4.

Figure 1:
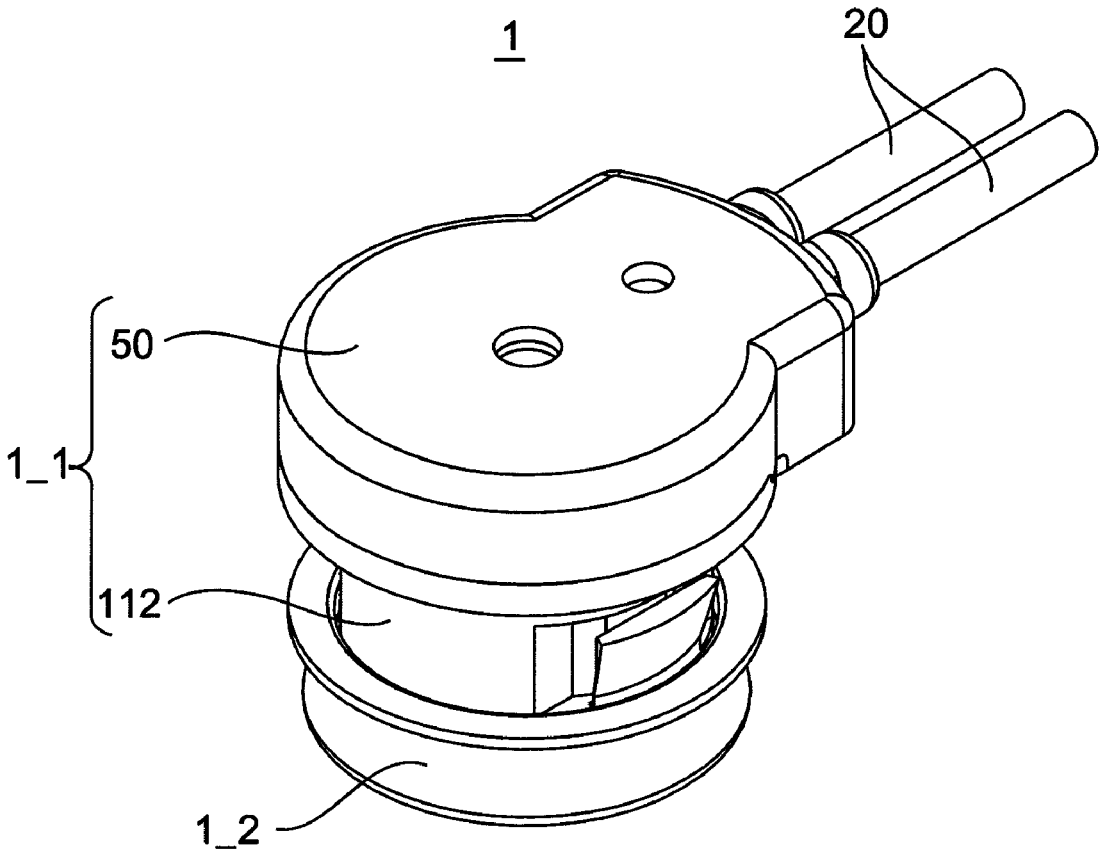
FIG. 1 is a perspective view of a connector according to an embodiment of the present invention.

A contact containing chamber 1124 is formed in the fitting section 112 of the connector 1 shown in FIG. 1. Contacts 30 and a ferrite core 40 are housed in this contact containing chamber 1124. The contacts 30 are connected to ends of the wires 29, and the ferrite core 40 has an oblong and hollow shape for noise absorption. Meanwhile, the contact holes 1125 for connecting the contact containing chamber 1124 to the outside, which are also illustrated in FIG. 3, are formed in the front face 1122 of the fitting section 112. When the connector 1 is mated with the mating connector, male contacts (not shown) of the mating connector are inserted to the contact containing chamber 1124 through the contact holes 1125 and touch the contacts 30.

Figure 4:
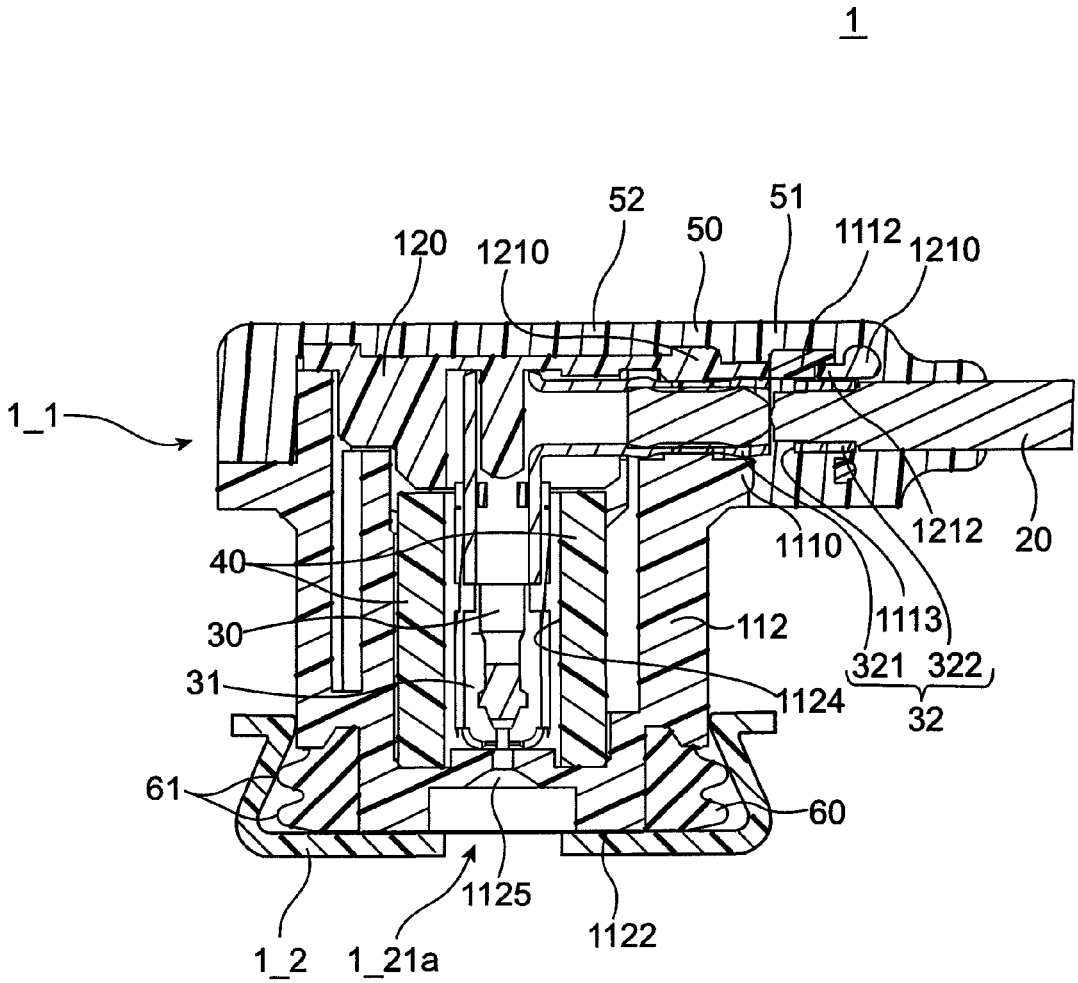
FIG. 4 is a cross-sectional view of the connector shown in FIG. 1 to FIG. 3B.

As shown in FIG. 4, each of the contacts 30 is a female contact to be mated with the male contact of the mating connector, which is formed by stamping, forming and plating operations. The contact 30 has a substantially L-shape and includes a contact section 31 to be in contact with the male contact of the mating connector, and a wire connecting section 32 to be connected to the end of the wire 20. The wire connecting section 32 includes a core-wire pressure-bonding section 321 for pressure-bonding a core wire of the wire 20, and an insulation-coating pressure-bonding section 322 for pressure-bonding the insulation coating of the wire 20.

Moreover, a cap housing 120 for covering an upper portion of the fitting section 112 is provided between the body 50 and the fitting section 112 of the connector body 1_1. This cap housing 120 includes a wire-end cladding section 1210 for cladding a wire-end container section 1110 of the fitting section 112.

This wire-end cladding section 1210 includes a claw member 1212 that comes between the end of the wire 20 to be housed in the wire-end container section 1110 and an electric-wire locking portion 1112. This claw member 1212 prevents the cap housing 120 from falling from the upper portion of the fitting section 112. Moreover, this claw member 1212 prevents the wire-end cladding section 1210 from being lifted up when an upward (upward in FIG. 4) force is applied to the wires 20.

Further, the wire-end container section 1110 includes a through hole 1113, which is formed in a position where the core-wire pressure-bonding section 321 of the wire connecting section 32 is exposed in the state prior to forming of the body 50 and when the wire connecting sections 32 of the contacts 30 and the wires 20 are housed in the wire-end container section 1110.

Meanwhile, the body 50 is poured in from the through hole 1113 formed on the wire-end container section 1110 and is filled in a portion around the end of each of the wires 20 inclusive of the core-wire pressure-bonding section 321 of the wire connecting section 32 housed in the wire-end container section 1110. In a conventional connector, since this filling is not performed, there is a risk of water entering the surroundings of the ends of the wires inclusive of the core-wire pressure-bonding sections of the wire connecting sections when the body is removed from an insulation housing. However, according to the connector 1 of the present invention, the waterproof property of the connector 1 is maintained by the body 50, which is poured in from the through hole 1113, filling around the ends of the wires 20 that are housed in the wire-end container section 1110.

As shown in FIG. 4, the connector 1 of the present invention includes a connector body 1_1 and a seal protection cap 1_2. The connector body 1_1 includes a cap housing 120, the body 50, and the fitting section 112 which is provided with the seal 60. The seal protection cap 1_2 has a front face plate 1_21 provided with an opening 1_21*a* that allows inspection from the front face 1122 of the fitting section 112 to be fitted to the fitting concave section of the mating connector. For this reason, it is possible to carry out a continuity check by touching the contacts 30 disposed inside the connector body 1_1 when the seal protection cap 1_2 is on the connector body 1_1. Moreover, through the opening 1_21*a*, it is also possible to check whether the contacts 30 and the ferrite core 40 are disposed inside the connector body 1_1. It is therefore possible to improve workability. Further, as shown in FIG. 3A, this seal protection cap 1_2 includes the protection section 1_22, which extends cylindrically from the peripheral edge of the front face plate 1_21 along the side face of the fitting section 112, so as to cover the seal 60. In this way, it is possible to protect the fitting section 112 and the seal 60 reliably.

Moreover, the seal protection cap 1_2 is made of transparent polypropylene. Accordingly, it is possible to check the presence and external appearance of the seal 60 that surrounds the side face of the fitting section 112 with the seal protection cap 1_2 kept on the connector body 1_1. In this way, workability can be further improved.

In addition, when manufacturing this connector 1, as will be described later, it is possible to carry out a forming operation to form the body 50 on the connector body 1_1 (a connector body portion) with the seal protection cap 1_2 kept on the connector body 1_1. Therefore, this connector 1 is excellent in forming operability.

Next, a method of manufacturing the connector 1 will be described.

Figure 5:
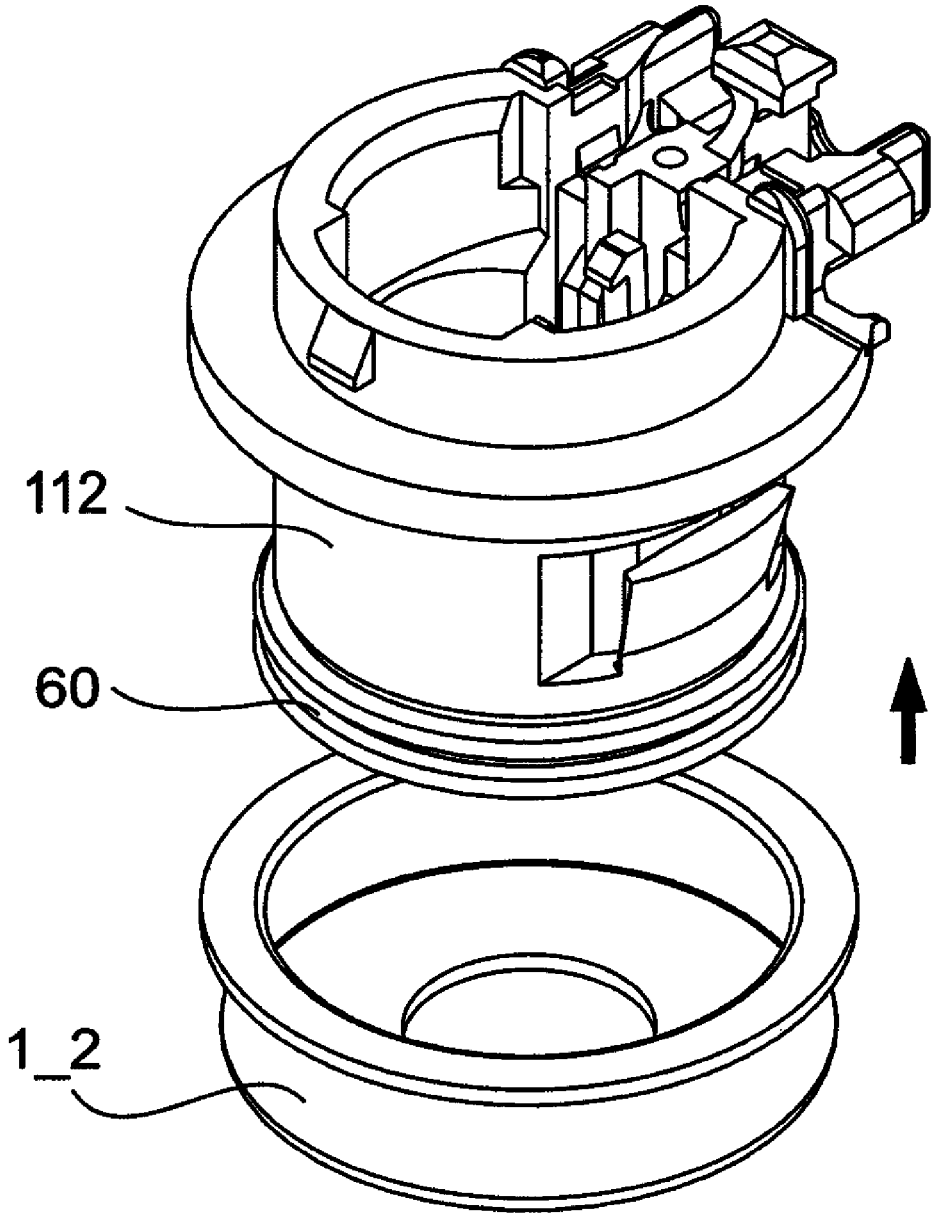
FIG. 5 is a perspective view of a fitting section with a seal attached thereto and a seal protection cap put thereon.
Figure 6:
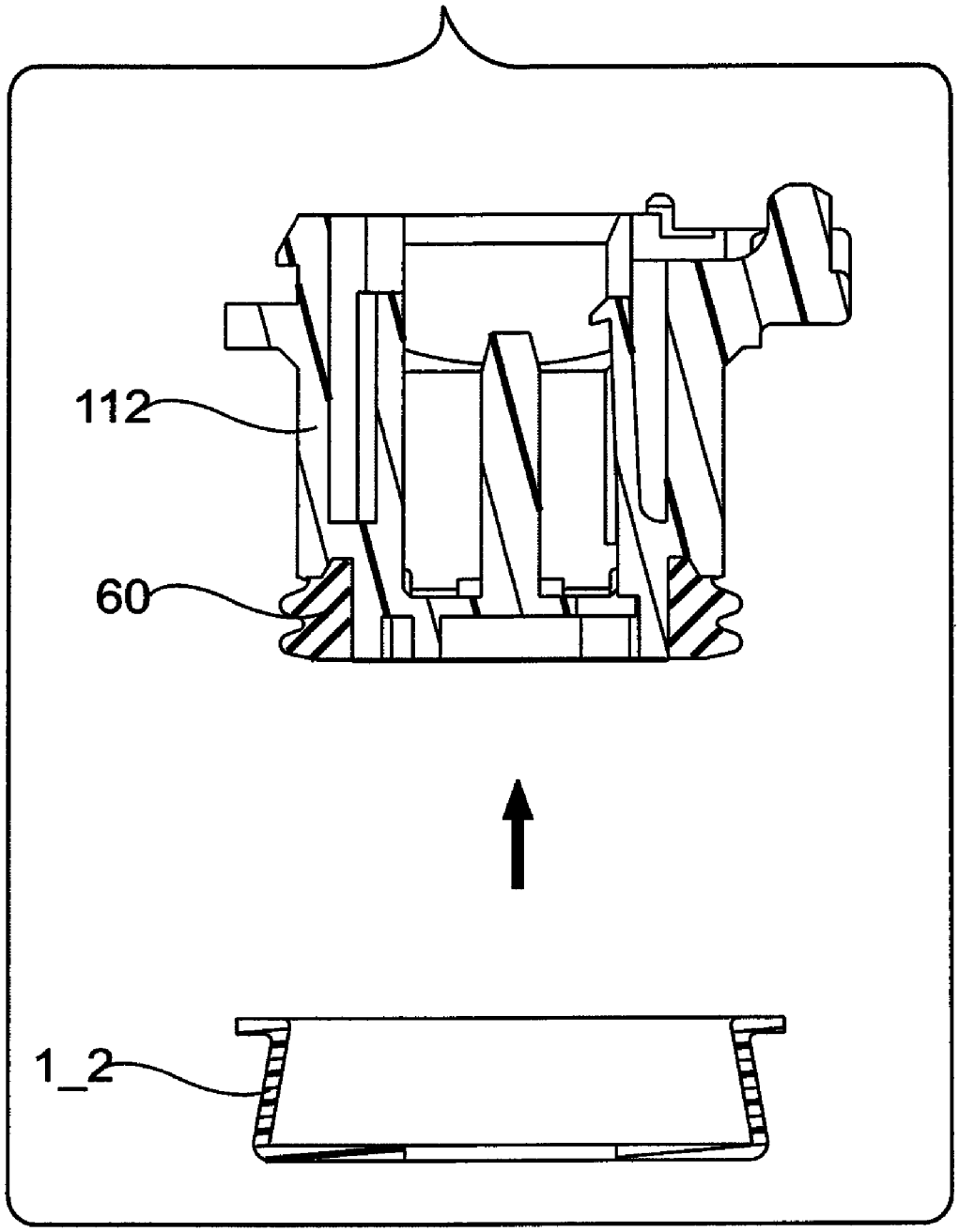
FIG. 6 is a cross-sectional view of the fitting section with the seal attached thereto and the seal protection cap put thereon.

First, as shown in FIG. 5 and FIG. 6, the seal protection cap 1_2 is put on the fitting section 112 with the seal 60 attached thereto. Next, the ferrite core 40 and the contacts 30 connected to the wires 20, which are not illustrated in FIG. 5 and FIG. 6, are inserted into the fitting section 112 from above.

Figure 7:
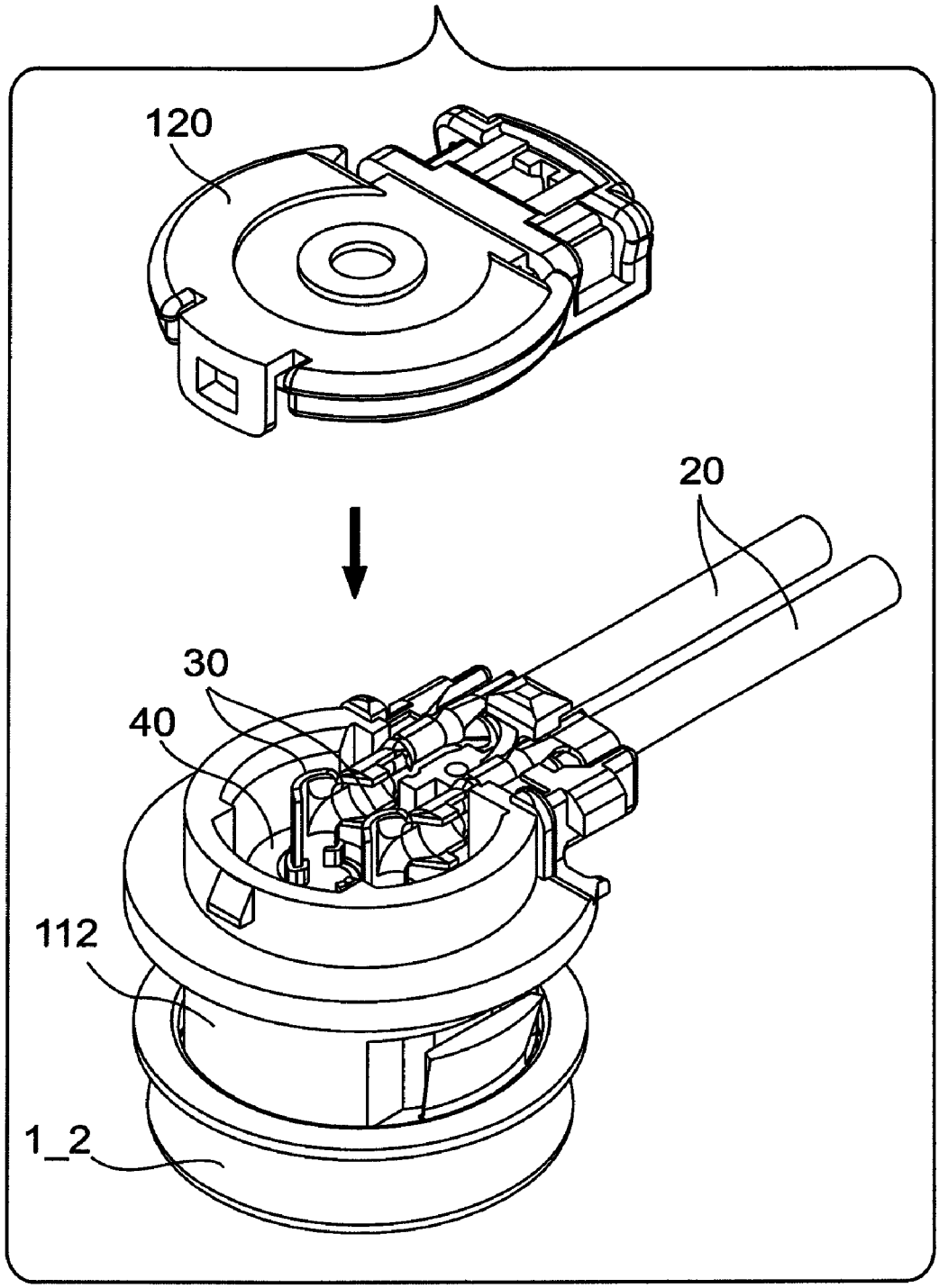
FIG. 7 is a view showing how a cap housing is fitted to the fitting section with the seal protection cap put thereon and contacts housed therein, the contacts connected to a ferrite core and wires.
Figure 8:
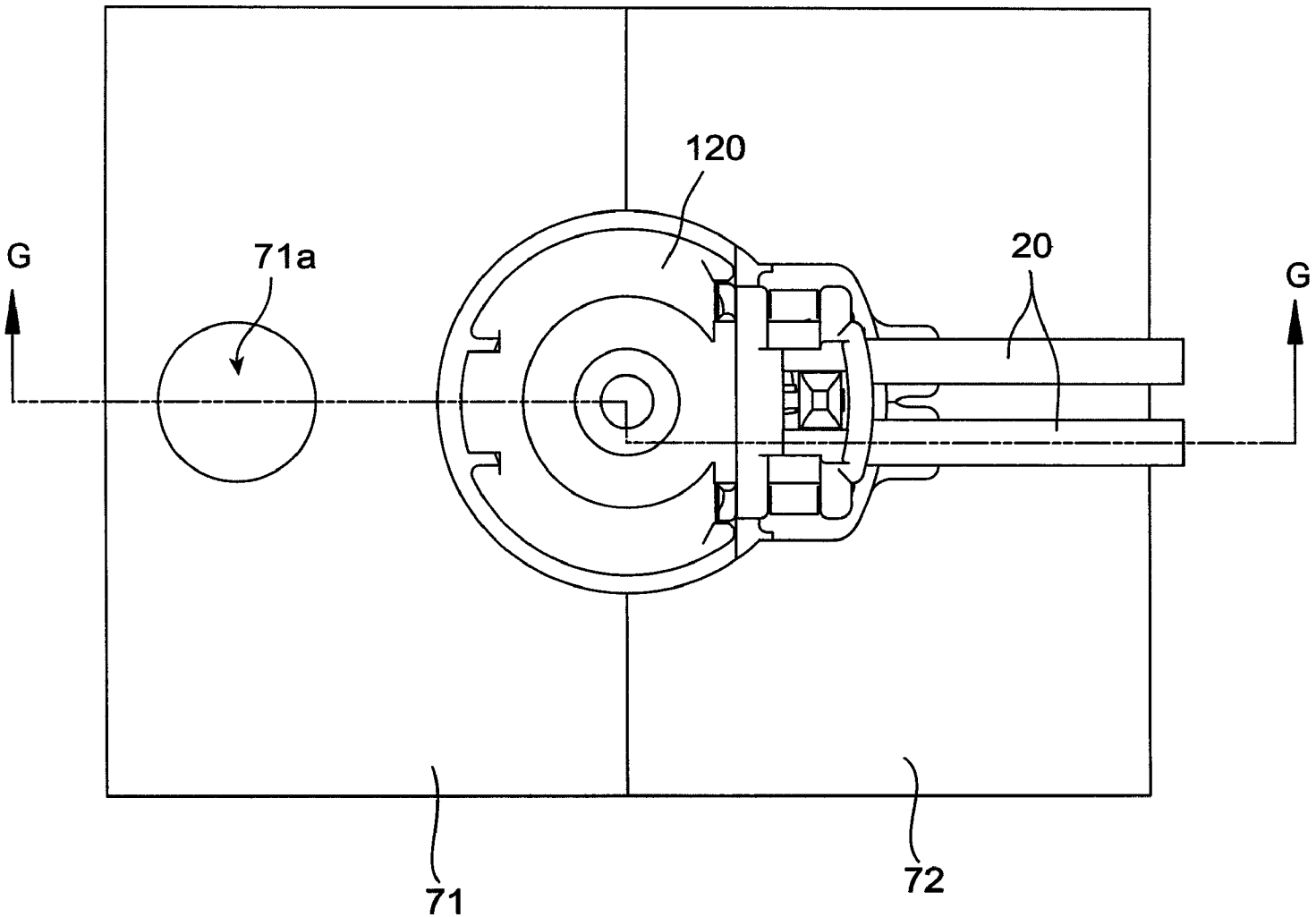
FIG. 8 is a plan view showing a connector body portion with the seal protection cap attached thereto and also showing lower mold sections.

FIG. 7 is a view showing how the cap housing 120 is fitted to the fitting section 112 having the seal protection cap 1_2 thereon and the contacts 30 housed therein, the contacts having been connected to the ferrite core 40 and the wires 20.

FIG. 7 shows the fitting section 112 provided with the seal protection cap 1_2 put thereon, the ferrite core 40 housed inside the fitting section 112, and the two contacts 30 connected to the two wires 20 housed to be surrounded by the ferrite core 40. The cap housing 120 is fitted to the fitting section 112, thereby making the connector body 1_1 without the body 50. Here, the connector body 1_1 without the body 50 will be hereinafter referred to as the connector body portion for the convenience of explanation.

Further, as described below, the body 50 is formed on the upper portion of the cap housing 120 by using a mold including lower mold sections and an upper mold section.

Figure 9:
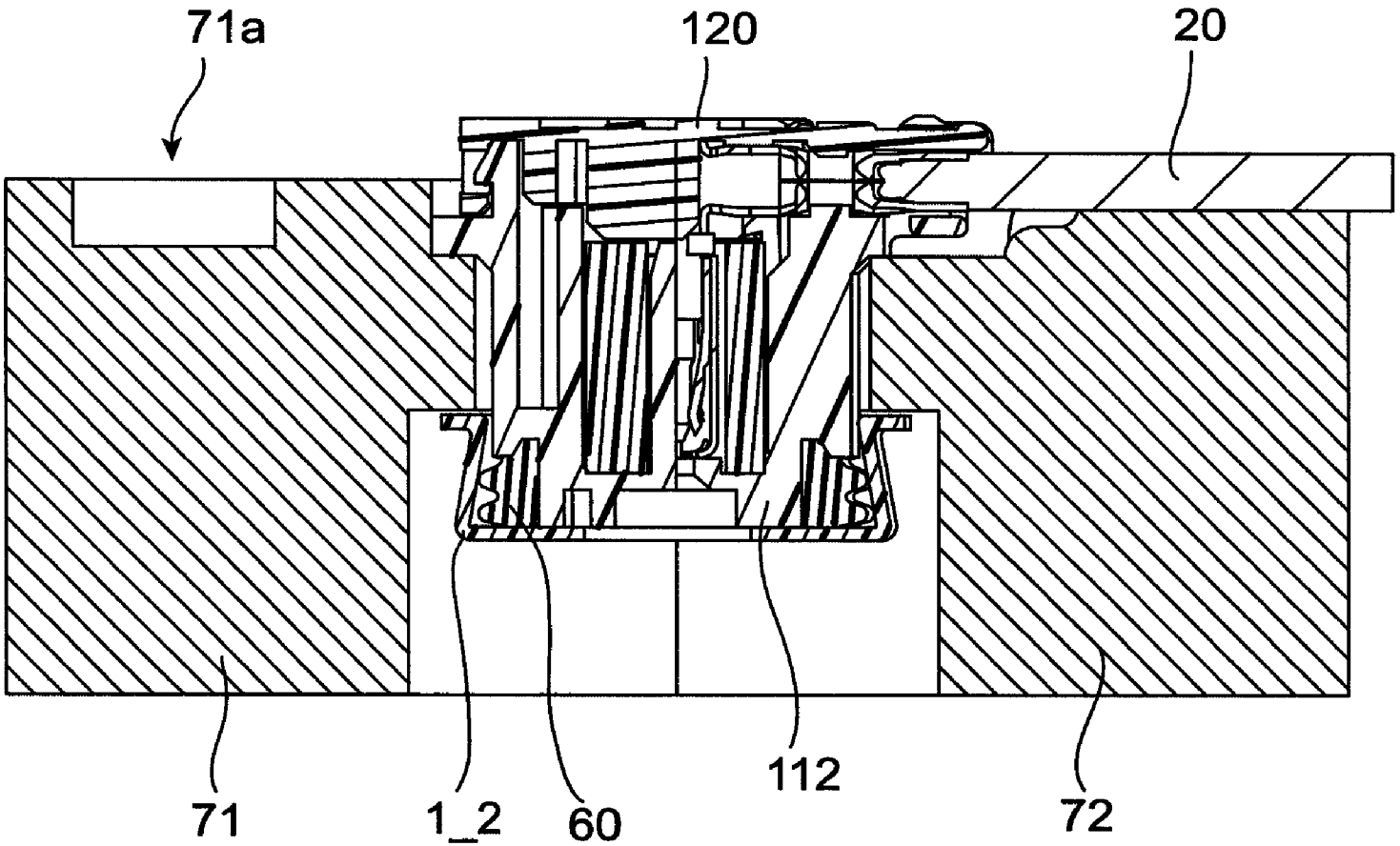
FIG. 9 is a cross-sectional view taken along a line G-G of FIG. 8.
Figure 10:
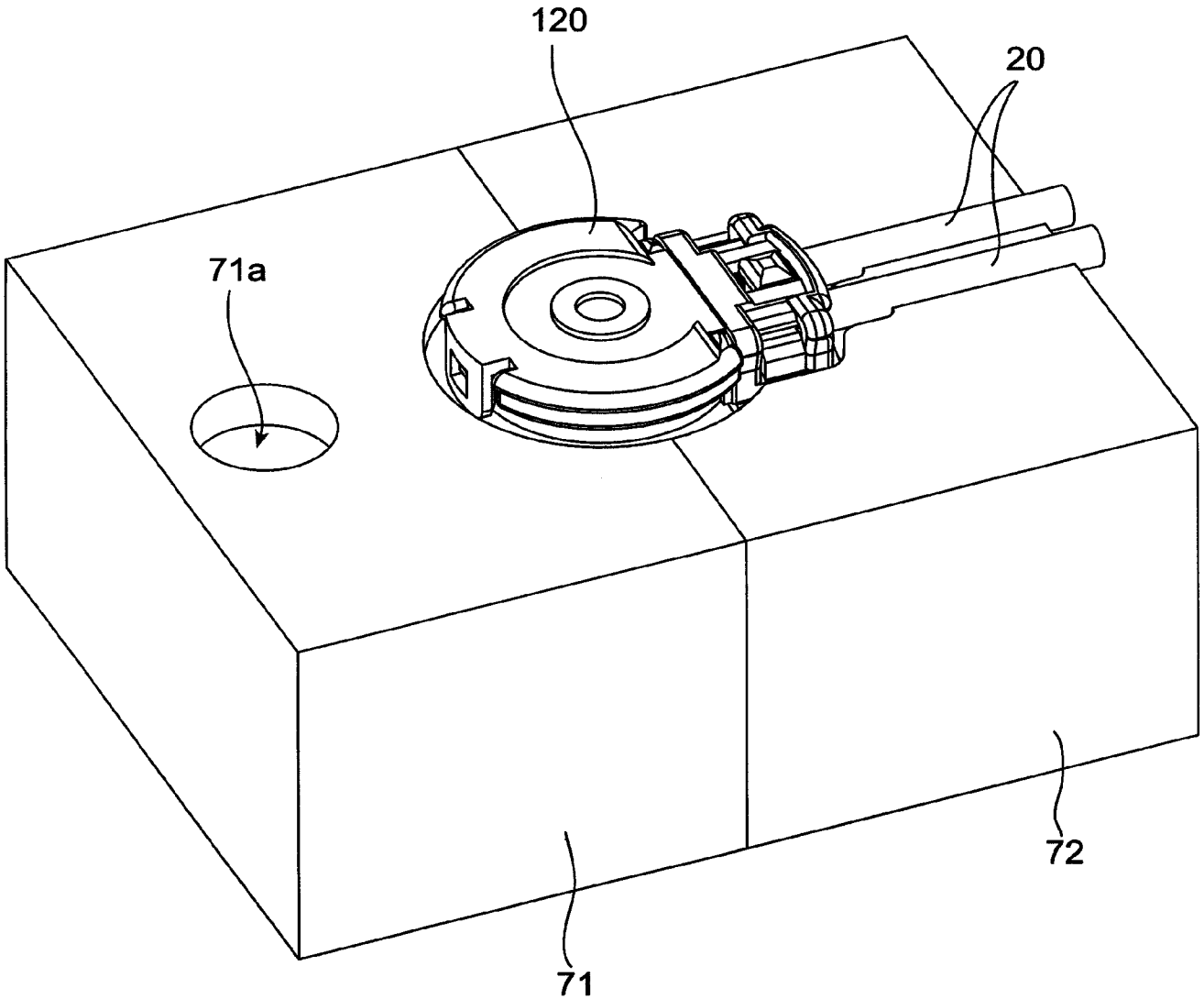
FIG. 10 is a perspective view showing an external appearance of the connector body portion with the seal protection cap attached thereto and of the lower mold sections.
Figure 11:
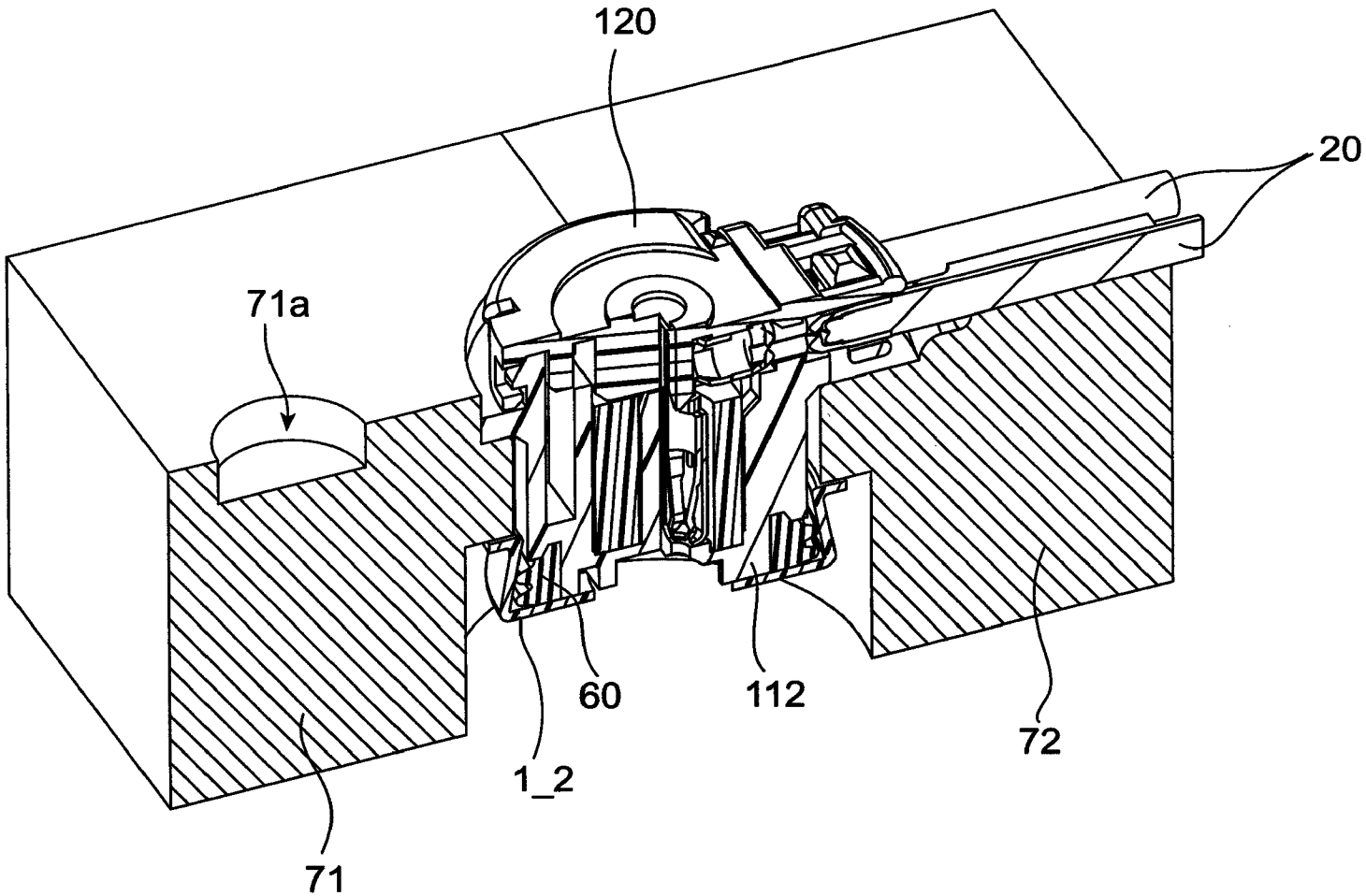
FIG. 11 is a cross-sectional view of the connector body portion with the seal protection cap attached thereto and the lower mold sections shown in FIG. 10.

A first lower mold section 71 and a second lower mold section 72 of the mold are shown in FIG. 8 to FIG. 11. The first lower mold section 71 is provided with a hole 71 a in which a insulative material for forming the body 50 is poured by way of the upper mold section to be described later. Meanwhile, as shown in FIG. 9 and FIG. 11, the seal 60 is attached to the side face of the fitting section 112. The seal protection cap 1_2 is put so as to cover this seal 60.

First, the first and second lower mold sections 71 and 72 are arranged away from each other by a predetermined distance, and then the fitting section 112 with the cap housing 120 and the seal protection cap 1_2 attached thereto is placed on these first and second lower mold sections 71 and 72. Subsequently, these first and second lower mold sections are joined to each other and an upper mold section to be described later is further put thereon so as to close the mold.

Figure 12:
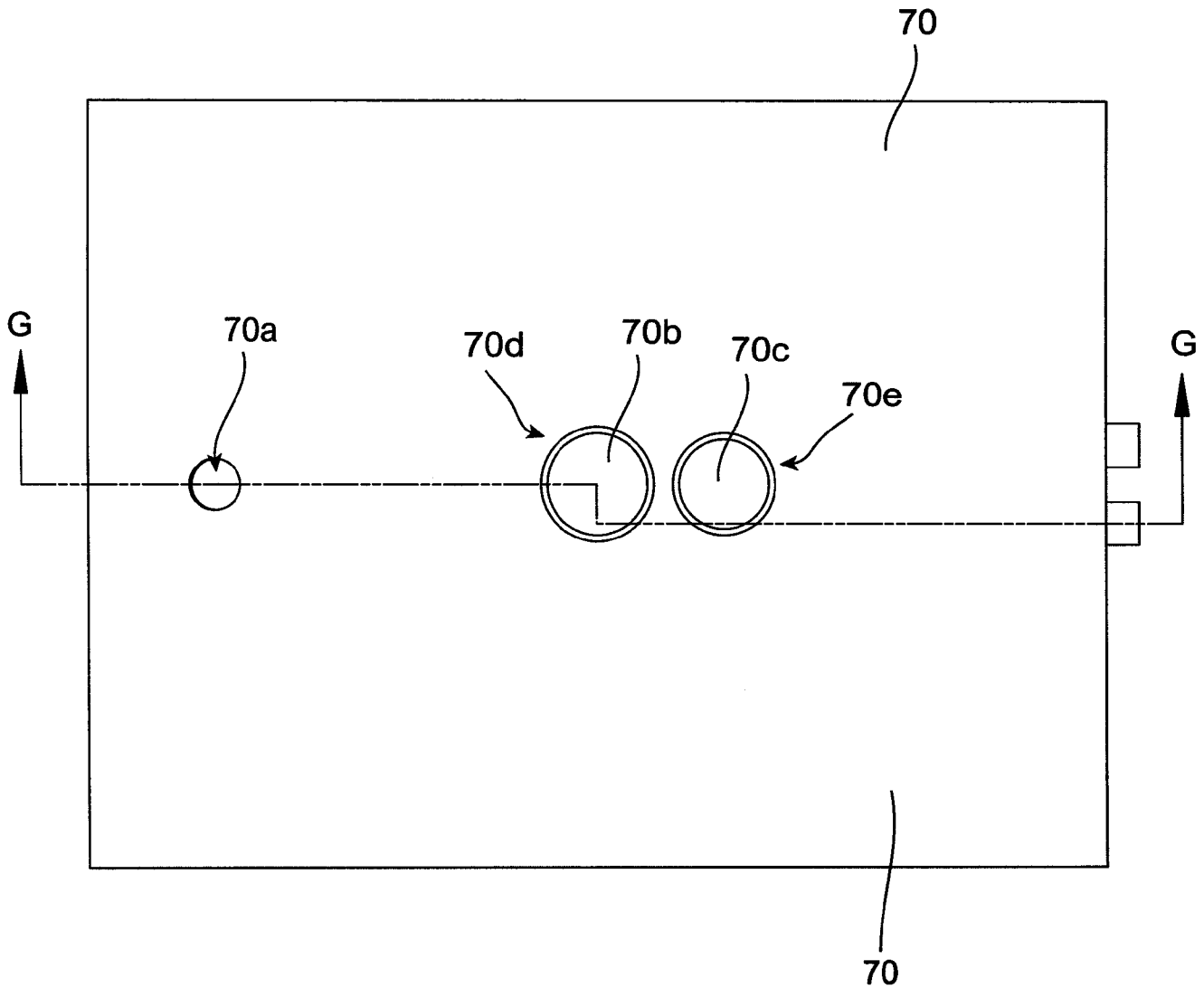
FIG. 12 is a plan view showing an upper mold section of a mold.
Figure 13:
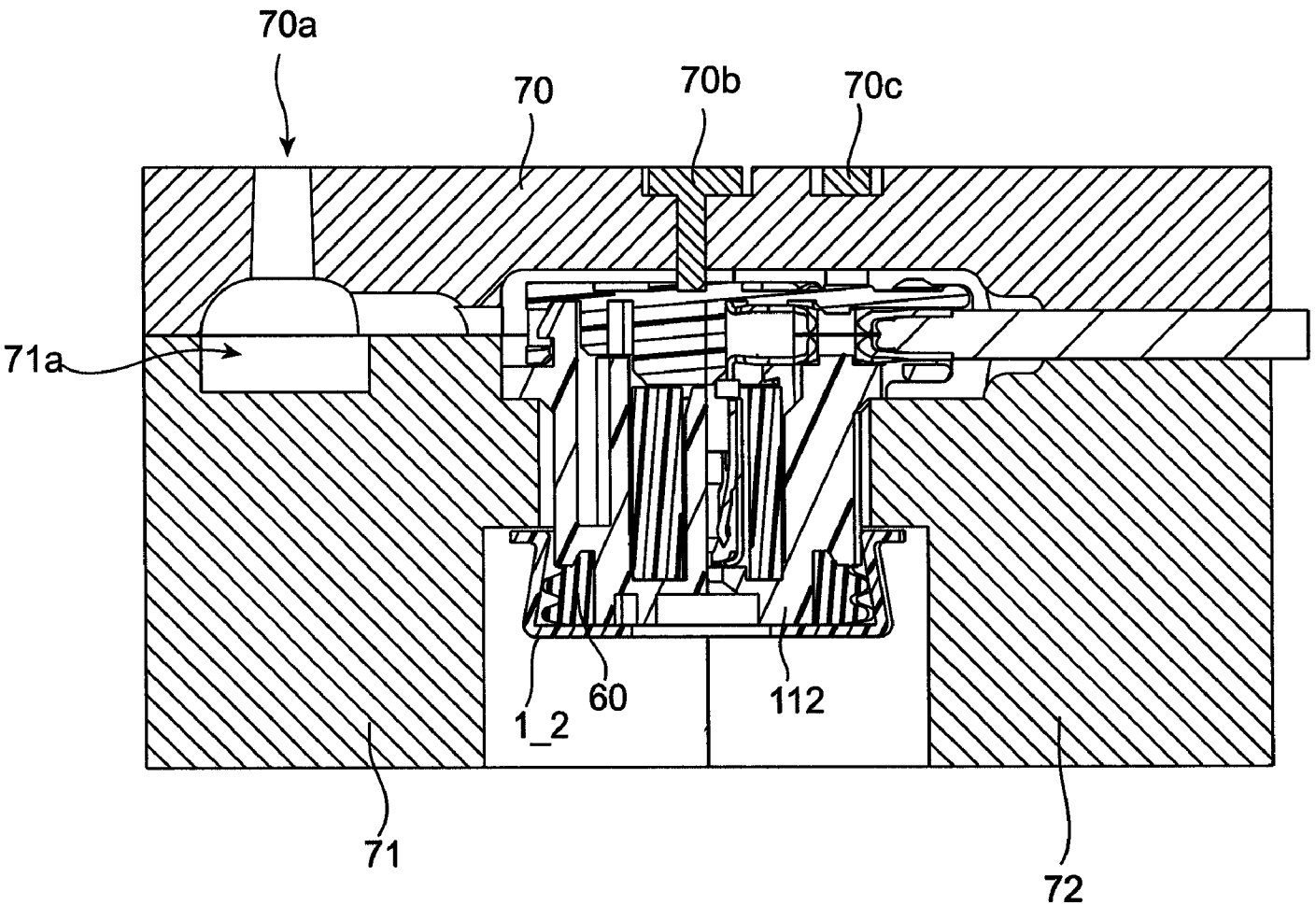
FIG. 13 is a cross-sectional view of the mold taken along a line G-G of FIG. 12.
Figure 14:
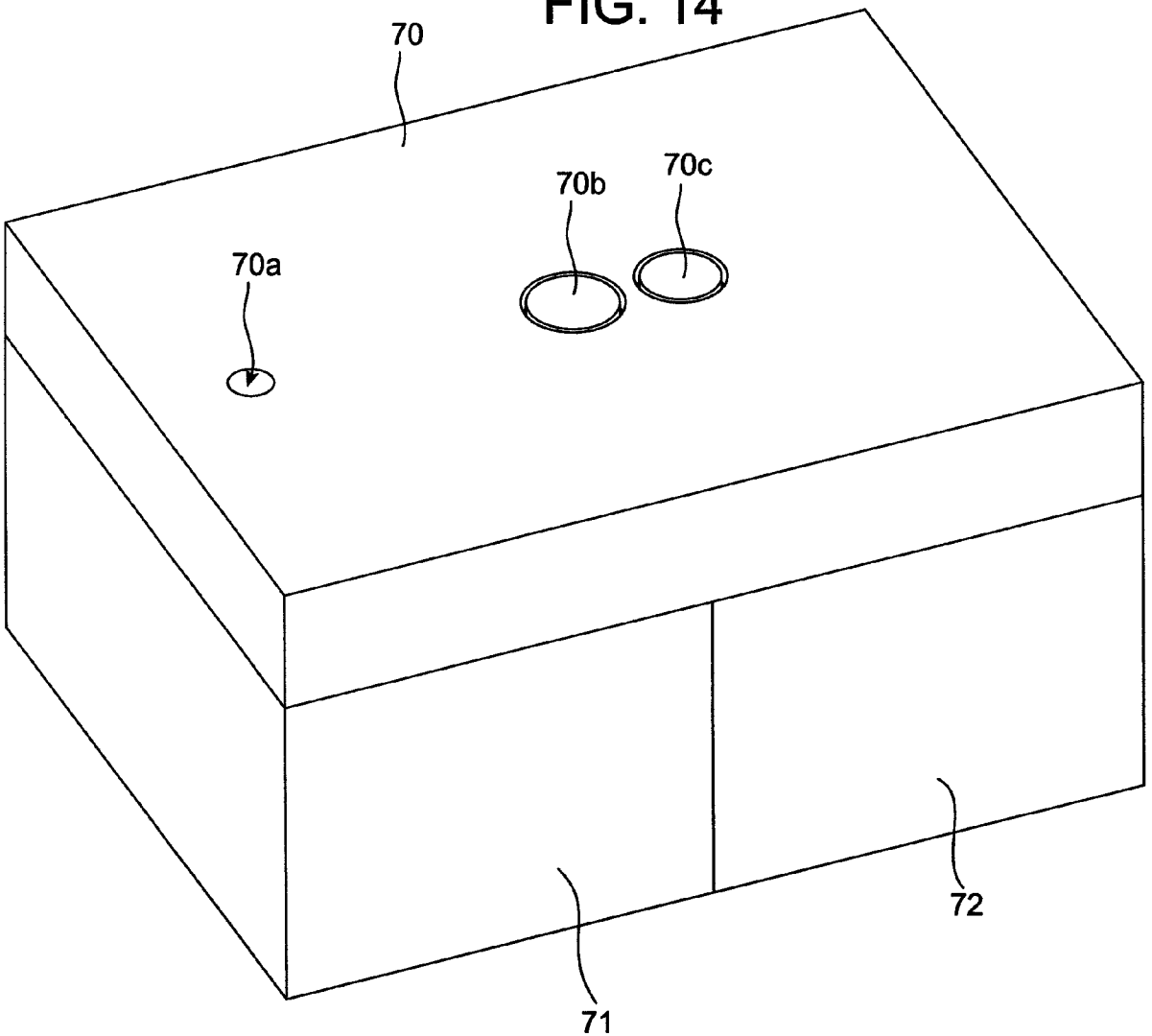
FIG. 14 is a perspective view showing an external appearance of the mold in a closed state.
Figure 15:
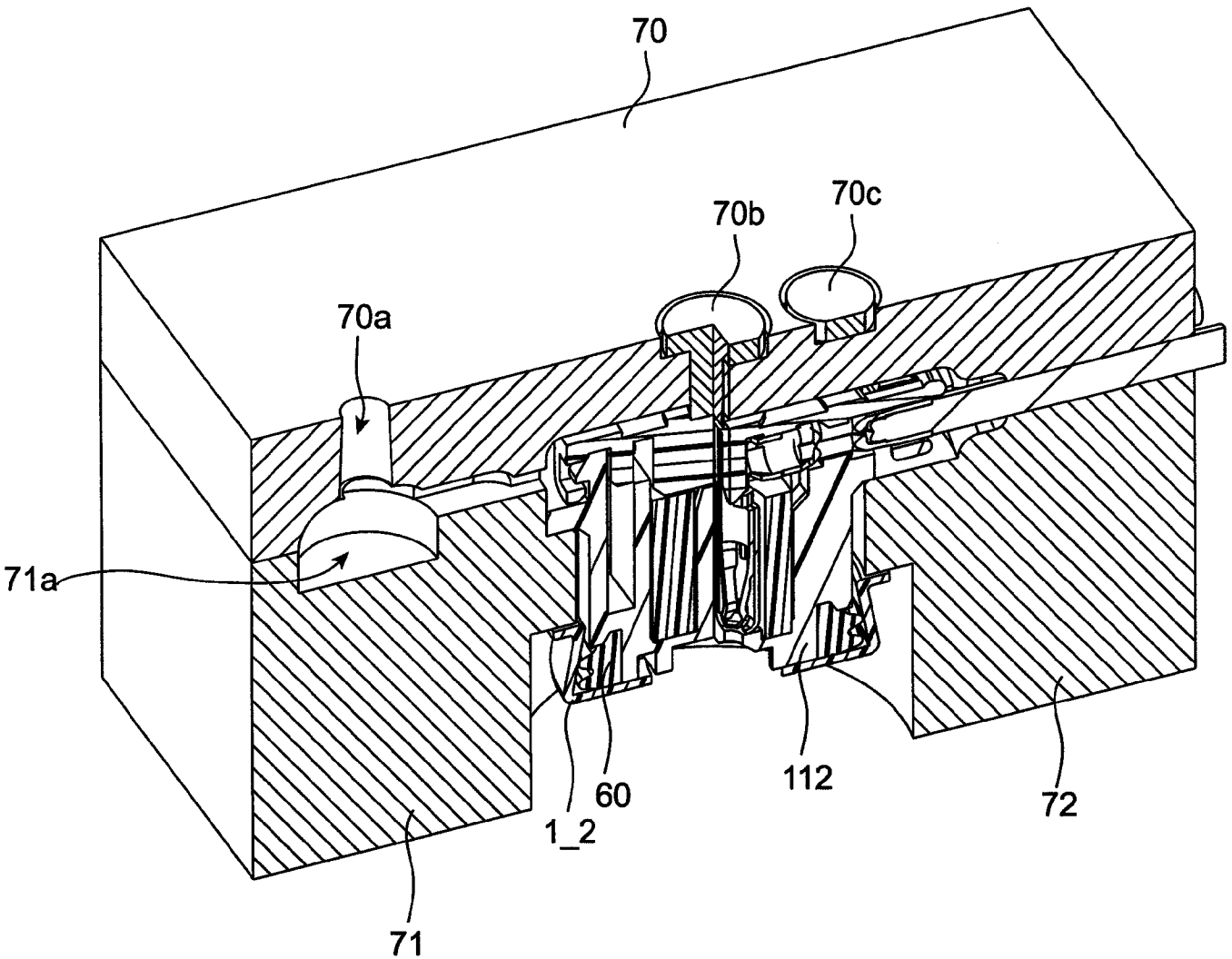
FIG. 15 is a cross-sectional view of the mold shown in FIG. 14.

An upper mold section 70 of the mold is shown in FIG. 12 to FIG. 14. The upper mold section 70 is provided with a hole 70*a* in which the insulative material for forming the body 50 is poured. As shown in FIG. 13 and FIG. 15, this hole 70*a* communicates with the hole 71*a* provided on the first lower mold section 71. The insulative material is poured into an inner space defined by the first and second lower mold sections 71 and 72 and the upper mold section 70 by way of these holes 70*a* and 71*a*. Meanwhile, as shown in FIG. 12, support pins 70*b* and 70*c* for supporting the cap housing 120 are respectively fitted into holes 70*d* and 70*e* provided on an upper face of the upper mold section 70.

Here, as shown in FIG. 12 to FIG. 15, the upper mold section 70 is put on the first and second lower mold sections 71 and 72 so as to close the mold. Subsequently, the insulative material is poured into the mold as described below.

Figure 16:
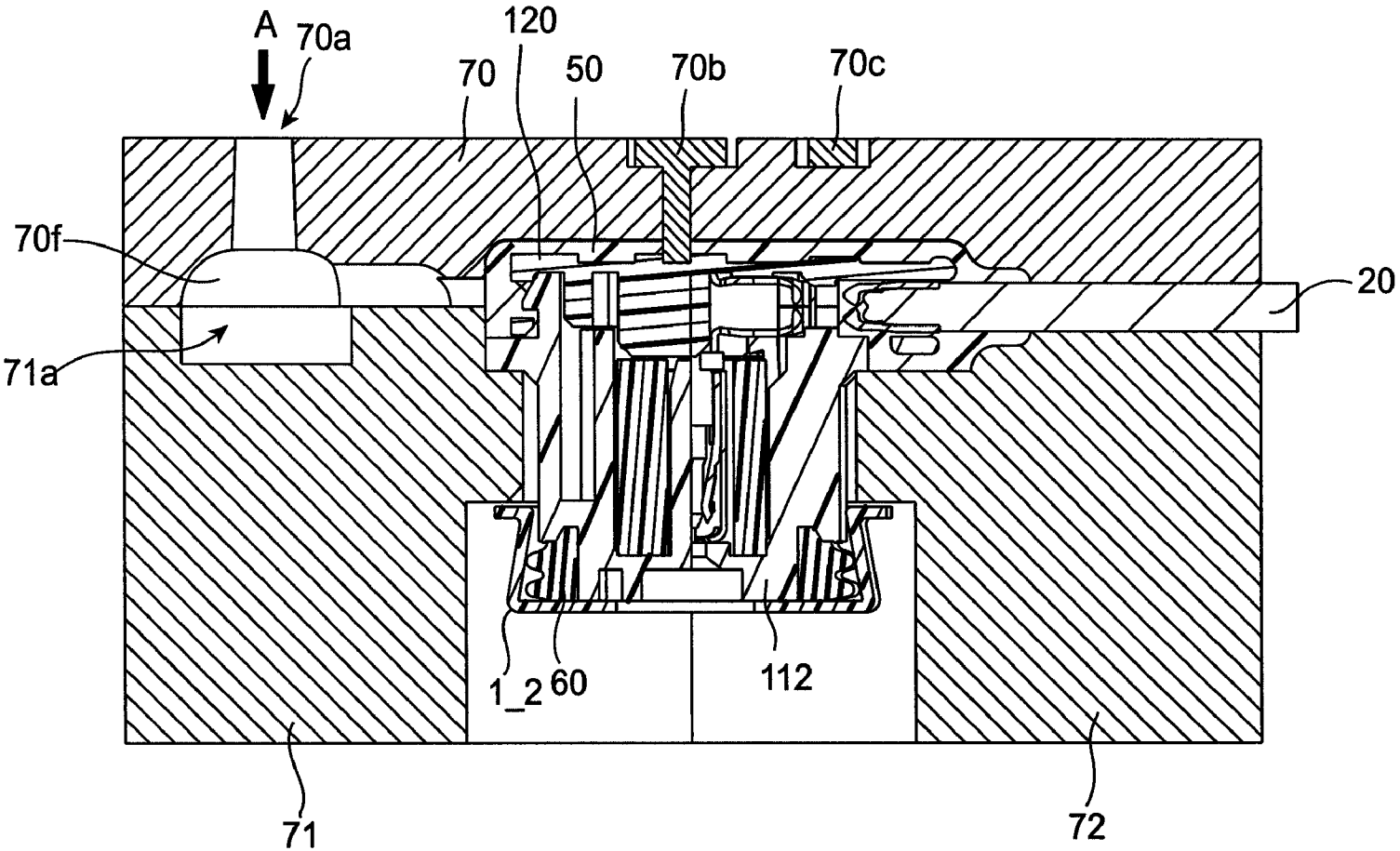
FIG. 16 is a cross-sectional view of the mold taken along the line G-G of FIG. 12.
Figure 17:
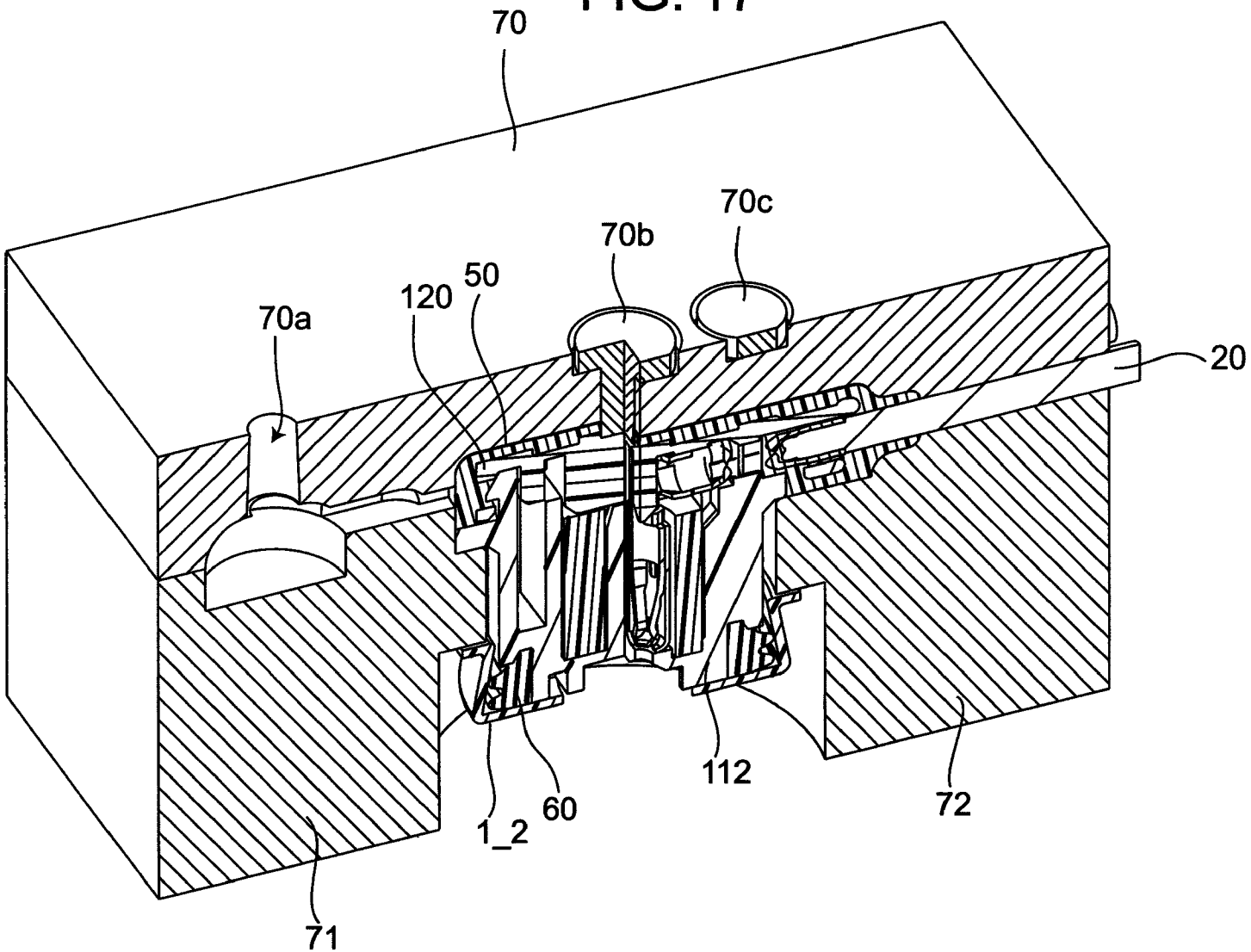
FIG. 17 is a cross-sectional view of the mold shown in FIG. 16, which is viewed obliquely from above.

An insulative material A is poured from the hole 70*a* provided on the upper face of the upper mold section 70 as shown in FIG. 16. The insulative material A poured from the hole 70*a* passes through a reservoir portion 70*f* provided on a lower surface of the upper mold section 70 and through the hole 71*a* provided on the upper surface of the lower mold section 71, and then flows rightward in FIG. 16. The flowing insulative material A thus poured is filled in the upper portion of the cap housing 120 and a portion around the ends of the wires 20. In this way, the body 50 is formed so as to be integrated with the insulation of the wires 20. Then, the upper mold section 70 is detached from the first and second lower mold sections 71 and 72.

Figure 18:
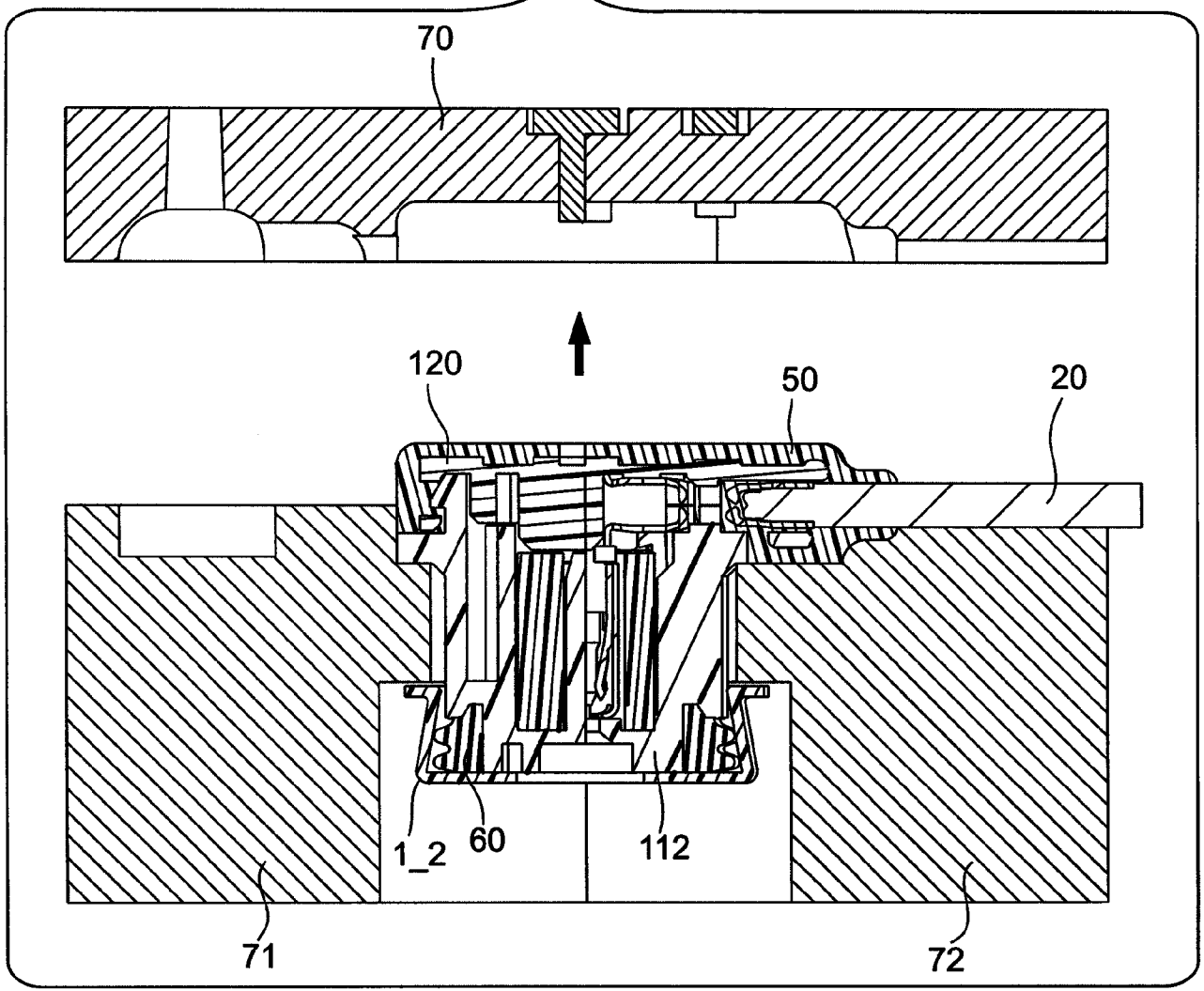
FIG. 18 is a cross-sectional view of the first and second lower mold sections and the upper mold section.
Figure 19:
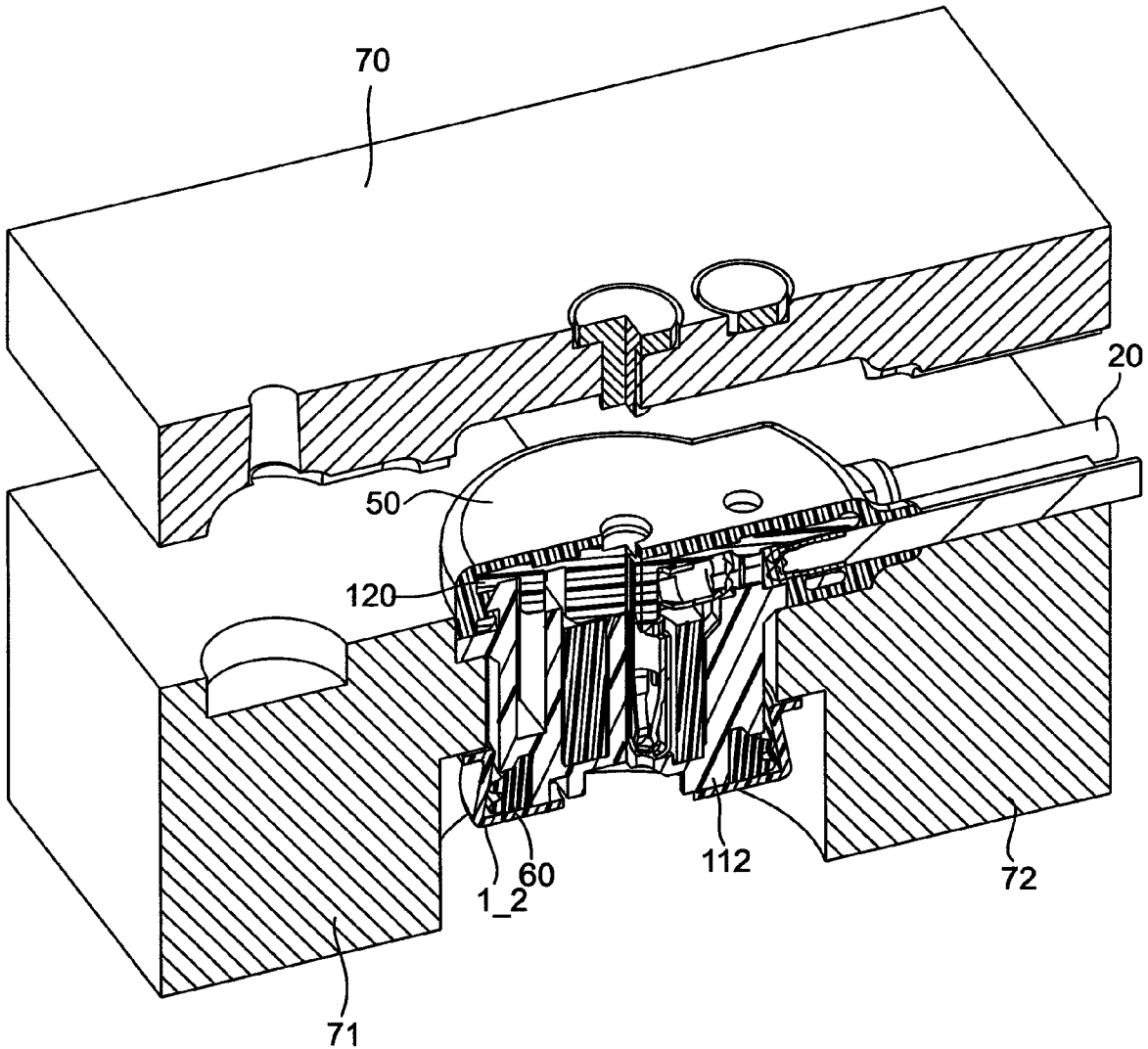
FIG. 19 is a cross-sectional view of the first and second lower mold sections and the upper mold section shown in FIG. 18, which is viewed obliquely from above.
Figure 20:
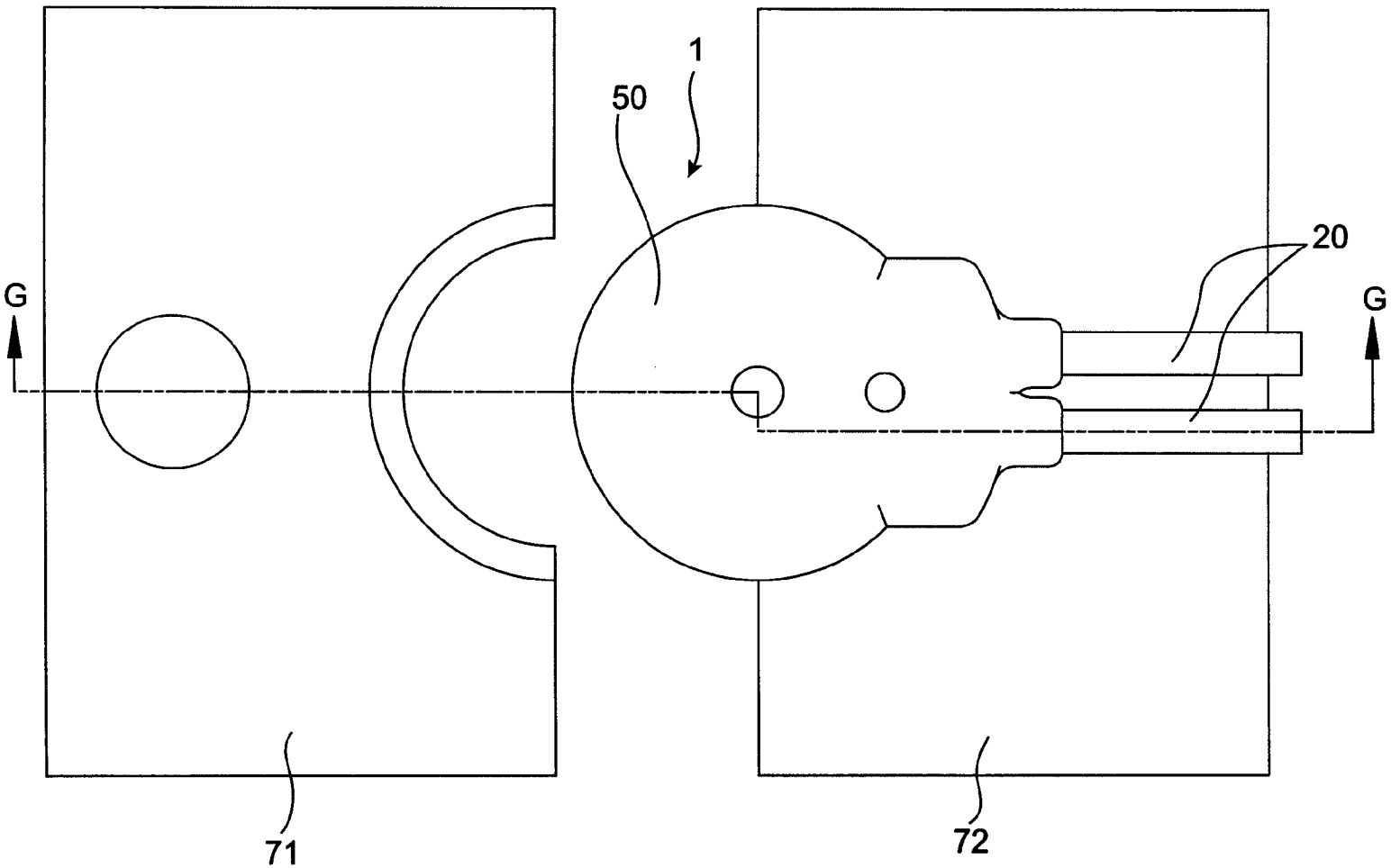
FIG. 20 is a plan view of the molded connecter and the first and second lower mold sections separated from each other.
Figure 21:
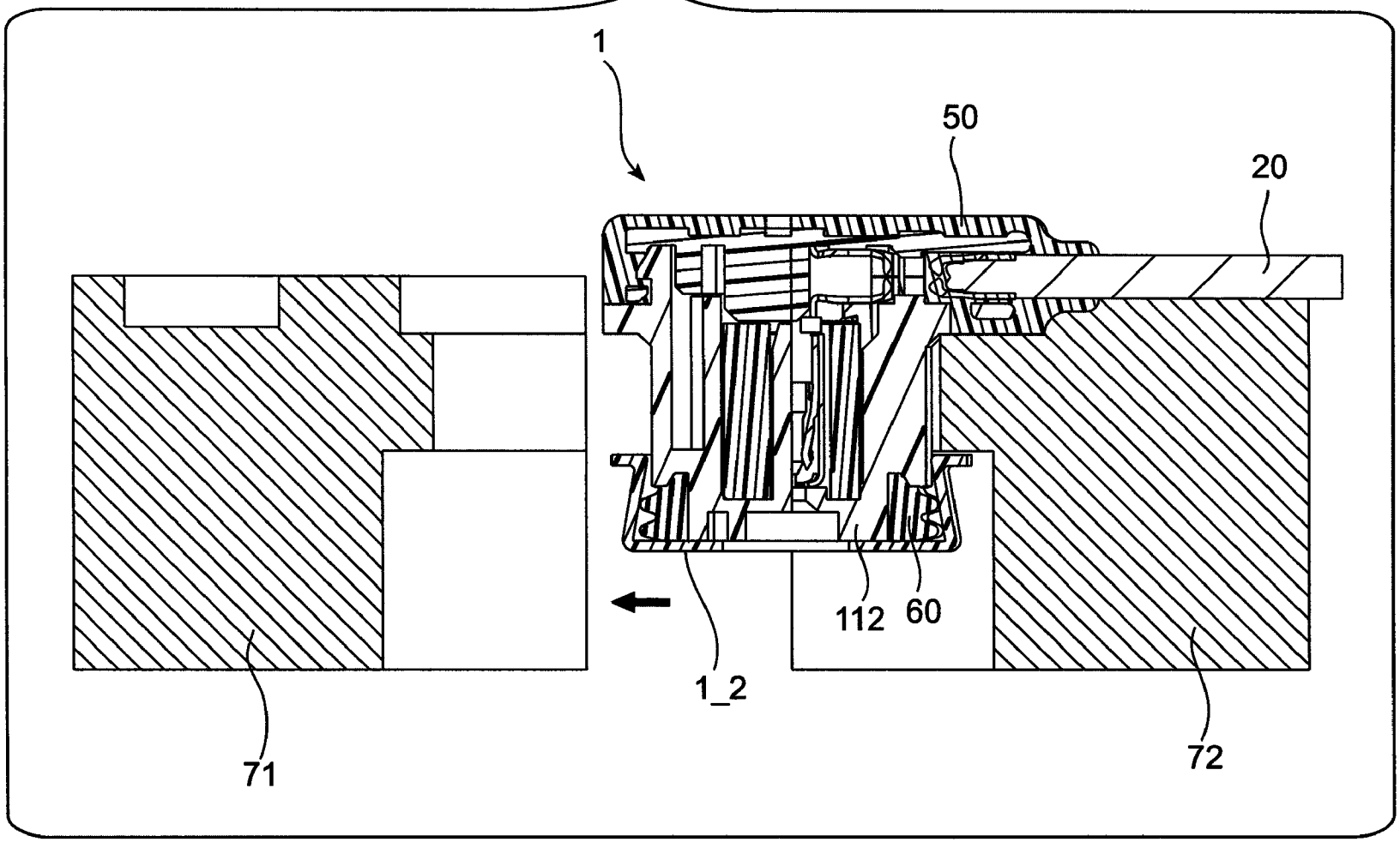
FIG. 21 is a cross-sectional view of the molded connector and the first and second lower mold section separated from each other, which is taken along a line G-G of FIG. 20.
Figure 22:
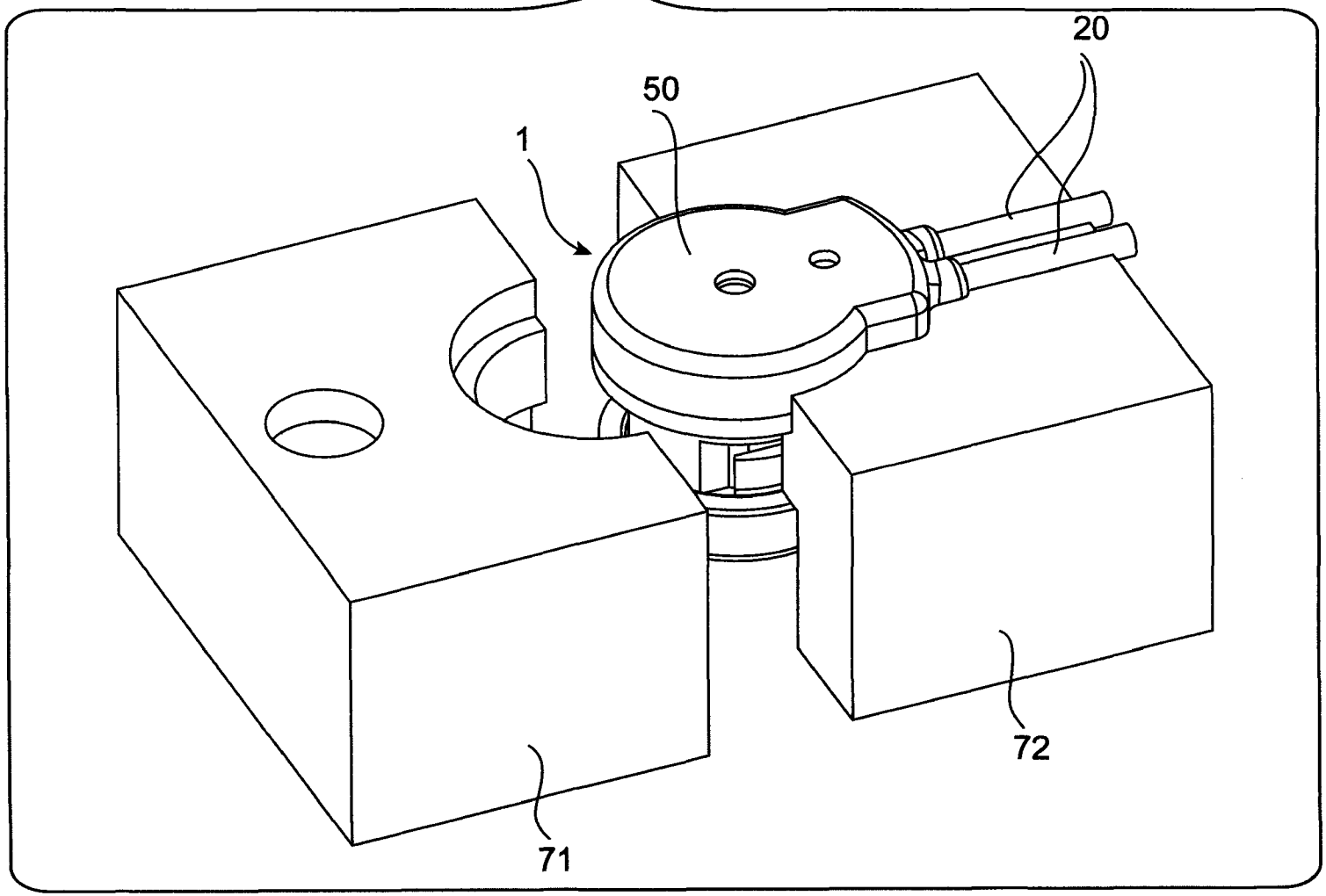
FIG. 22 is a perspective view showing an external appearance of the molded connector and the first and second lower mold sections separated from each other, which is viewed obliquely from above.
Figure 23:
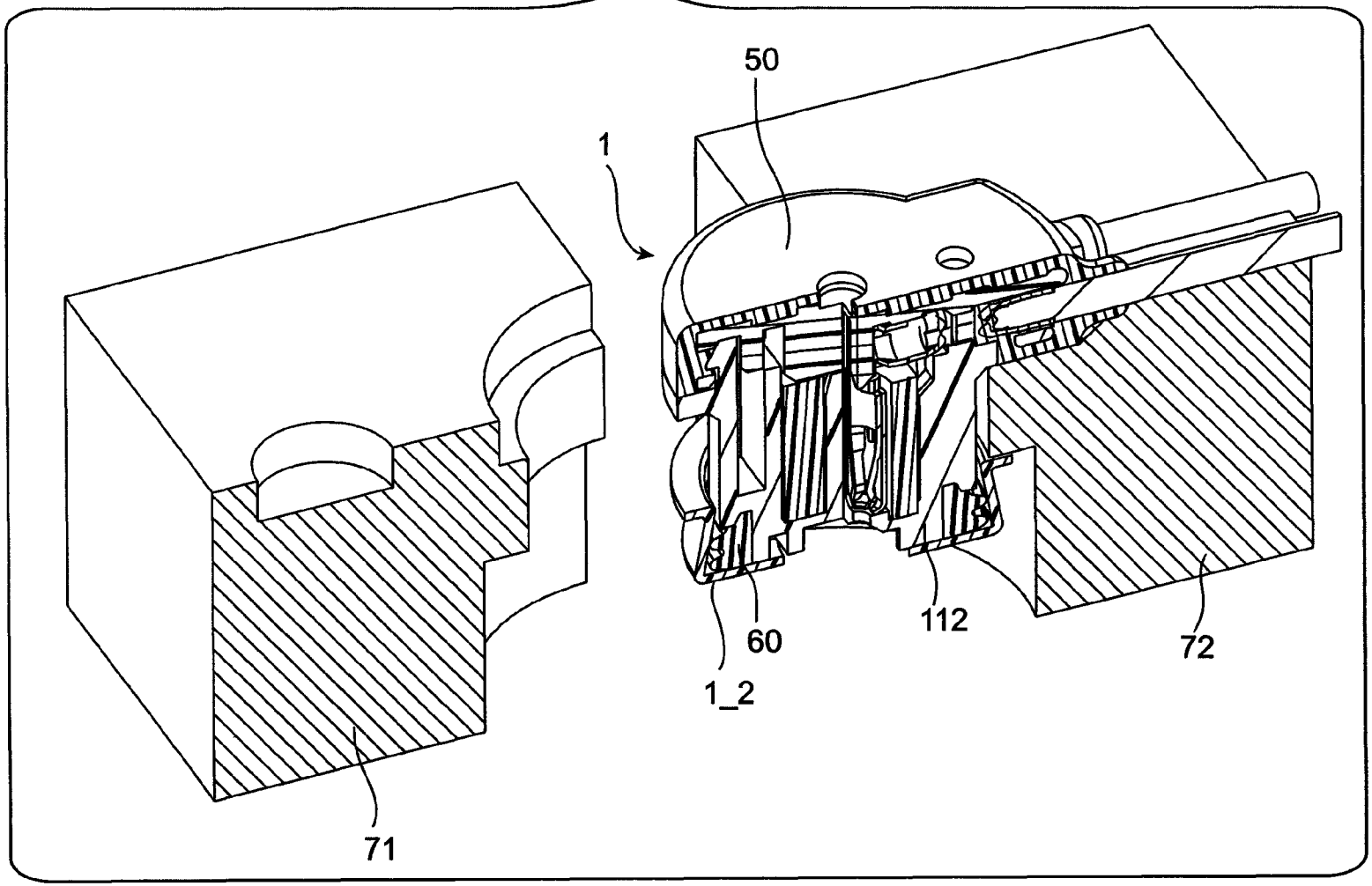
FIG. 23 is a cross-sectional view of the molded connector and the first and second lower mold sections separated from each other, which is viewed obliquely from above.

As shown in FIG. 18 and FIG. 19, the upper mold section 70 is detached upward from the first and second lower mold sections 71 and 72. FIG. 18 and FIG. 19 show the body 50 that is formed on the upper portion of the cap housing 120 and around the ends of the wires 20. Moreover, the formed connector 1 is taken out by separating the first lower mold section 71 from the second lower mold section 72, as described below.

The first lower mold section 71 is separated from the second lower mold section 72 as shown in FIG. 20 to FIG. 23, leaving the molded connector 1 in a state of being mounted on the second mold section 72. Subsequently, the formed connector 1 is taken out of the second lower mold section 72. In this way, the connector 1 of this embodiment is manufactured.

What is claimed is:

1. A seal protection cap for a connector body having a seal comprising:

a front face plate facing a the front face of an electrical connector body with a contact hole open to a contact disposed inside, and having an opening allowing a continuity check from the front face; and a protection section which extends cylindrically from a peripheral edge of the front face plate along a side face of the electrical connector body wherein the seal protection cap surrounds front and side surfaces of the seal.

2. The seal protection cap according to claim 1, wherein the seal protection cap is made of a material having a transparent property which allows the connector body to be visible through the seal protection cap.

3. An electrical connector comprising:

a connector body having a fitting section which is fitted to a fitting concave section of a mating connector and which has a contact hole formed in a front face thereof, the contact hole extending to reach a contact disposed inside the fitting section, and a seal surrounding a side face of the fitting section; and a seal protection cap having a front face plate which spreads to face the front face of the fitting section of the connector body and which has an opening allowing a continuity check from the front face, and a protection section which extends cylindrically from a peripheral edge of the front face plate along the side face of the fitting section wherein the seal protection cap surrounds front and side surfaces of the seal.

4. The connector according to claim 3, wherein the connector body includes a head section which is arranged at a rear portion of the fitting section in the fitting direction in which the fitting section is fitted to the mating connector, the head section sealing a portion around an wire extending out from the rear portion.

* * * * *